United States Patent [19]

Hayase et al.

[11] Patent Number: 5,009,577

[45] Date of Patent: Apr. 23, 1991

[54] ROTARY COMPRESSOR OF VARIABLE DISPLACEMENT TYPE

[75] Inventors: Isao Hayase, Katsuta; Kunisuke Tejima, Mito, both of Japan

[73] Assignee: Hitachi, Ltd., Tokyo, Japan

[21] Appl. No.: 425,128

[22] Filed: Oct. 20, 1989

[30] Foreign Application Priority Data

Oct. 28, 1988 [JP] Japan ..... 63-272659

[51] Int. Cl.[5] ..... F04B 49/02; F04B 21/02; F01C 21/00

[52] U.S. Cl. ..... 417/295; 417/442; 417/503; 418/15; 418/159; 418/184; 418/255

[58] Field of Search ..... 417/295, 442, 503; 418/183, 184, 15, 255, 159

[56] References Cited

U.S. PATENT DOCUMENTS

| | | | |
|---|---|---|---|
| 3,671,146 | 6/1972 | Alderson | 418/184 |
| 4,421,462 | 12/1983 | Ohe | 418/15 |
| 4,580,949 | 4/1986 | Maruyama et al. | 418/15 |
| 4,723,895 | 2/1988 | Hayase | 417/442 |
| 4,744,732 | 5/1988 | Nakajima et al. | 417/295 |
| 4,844,703 | 7/1989 | Watanabe et al. | 417/295 |

*Primary Examiner*—Leonard E. Smith
*Assistant Examiner*—John A. Savio, III
*Attorney, Agent, or Firm*—Antonelli, Terry, Stout & Kraus

[57] ABSTRACT

A rotary compressor of variable displacement type comprises a cylinder, a rotor accommodated in the cylinder in an eccentric relationship therewith, at least one vane incorporated in the rotor through an outer periphery of the latter and movable relative to the rotor reciprocatively in a longitudinal direction of the vane, and two side plates closing the cylinder at both axial ends of the latter. A suction port is formed in at least one of the side plates, while an opening portion is formed in a rear side portion of the vane as viewed in a direction of rotation of the rotor and being opened at a surface of the vane making sliding contact with the rotor. This opening portion is repeatedly communicated with and interrupted from a working space in the compressor according to the reciprocative movement of the vane relative to the rotor. A suction passage is formed in the vane, or in the vane and the rotor, for establishing communication between the suction port and the opening portion in a predetermined range of rotation of the rotor.

6 Claims, 17 Drawing Sheets

ROTARY COMPRESSOR OF VARIABLE DISPLACEMENT TYPE

BACKGROUND OF THE INVENTION

The present invention relates to a rotary compressor of variable displacement type, and in particular, to a rotary compressor of variable displacement type suitably used in an air-conditioning system for a vehicle.

In a conventional rotary compressor of variable displacement type as disclosed in Japanese Utility Model Unexamined Publication No. 57-58791, an eccentric rotor rotates in a housing having a suction port and vanes arranged in the rotor compress the fluid suctioned through the suction port and exhaust the compressed fluid through an exhaust port, an inner sleeve being rotatably arranged on the inner surface of the housing. The vanes contact the inner surface of the inner sleeve in a sliding manner, and the inner sleeve is formed with an adjusting port which cooperates with the suction port. The exhaust displacement or volume is controlled by rotating the inner sleeve, i.e. by changing the amount of overlap of the adjusting port with the suction port, in other words, by changing the substantial opening range of the suction opening.

In the above-mentioned prior art, a communication between the suction port and the working space starts when the front vane crosses over the starting point of the opening area formed by the suction port and the adjusting port, and finishes when the rear vane crosses over the terminal point of the opening area. In other words, a suction stroke starts when the front vane crosses over the starting point of the suction port opening range and finishes when the rear vane crosses over the terminal point of the suction port opening range. Consequence, denoting the angular range of the opening area of the suction port with respect to the rotor rotation center by $\theta p$, and the angle between adjacent vanes, i.e. the pitch angle of vanes in a circumferential direction by $\theta v$, the angular extent or range of the suction stroke is expressed by the sum of $\theta p$ $\theta v$.

In the conventional volume control technique, the suction port opening range $\theta p$ may be changed, possibly to zero, by rotating the inner sleeve. However, the vane pitch angle $\theta v$ can not be changed, because the vane pitch angle is determined by the number of vanes. Accordingly, the suction stroke is achieved at least in an angular range $\theta v$. Thus, the minimum volume of the working space can not be made smaller than the volume determined by the angle $\theta v$, thereby causing a problem that the minimum volume is limited in a volume control operation.

SUMMARY OF THE INVENTION

The object of the invention is to provide a rotary compressor of variable displacement type in which a sufficiently decreased minimum volume and a wide range of volume control can be realized.

A variable displacement rotary compressor to the invention, comprises a cylinder having an inner peripheral surface and both axial ends, with rotor means including a rotor being accommodated in the cylinder in an eccentric relationship therewith, and at least one vane incorporated in the rotor through an outer periphery of the rotor. The vane being is reciprocably movable relative to the rotor in a longitudinal direction of the vane, and two side plates close the cylinder at both ends thereof with the vane dividing a working space defined by the rotor, the cylinder, and the side plates into a plurality of spaces Suction port means are formed in at least one of the side plates and are opened at a surface of the side plate making siding contact with the rotor opening means are formed in a rear side portion of the vane as viewed in a direction of rotation of the rotor and are opened at a surface of the vane making sliding contact with the rotor The opening means being adapted to be repeatedly communicated with and interrupted from the working space according to the reciprocating movement of the vane relative to the rotor. A suction passage means is formed in the rotor means for establishing a communication between the suction port means and the opening means in a predetermined range of rotation of the rotor means.

In the arrangement of the invention, a suction stroke suctioning a fluid into the working space through the opening means starts when the suction passage means starts to establish communication between the suction port means and the opening means, and finishes when this communication is interrupted. Accordingly, denoting the angle of opening range or area of the suction passage means with respect to the rotor center by $\theta s$, and the angular range of the suction port means by $\theta p$, the angular extent of the suction stroke is expressed as the sum of $\theta s + \theta p$.

The angle $\theta s$ can be sufficiently small in comparison with the angle $\theta v$. As a result, it become possible to make the suction stroke $\theta s + \theta p$ sufficiently small by sufficiently decreasing the angle $\theta p$, and a smaller minimum exhaust volume and a wider control range can be attained.

Further, in the present invention, the opening means is formed in the rear side portion of the vane as viewed in the direction of rotation of the rotor, and this opening means repeatedly communicates with and is interrupted from the working space according to the forward and rearward motions of the vane relative to the rotor. The opening means is closed due to the rearward motion of the vane into the inside of the rotor when the working space arrives at its maximum volume and the volume is just starting to decrease. By virtue of this arrangement, the high pressure gas produced in a compression stroke of the working space is prevented from flowing into the suction passage means through the opening means and leaking toward a low pressure side in the following suction stroke. Thus, an internal leakage in the compressor is prevented.

DETAILED DESCRIPTION OF PREFERRED EMBODIMENTS

Figure 1:
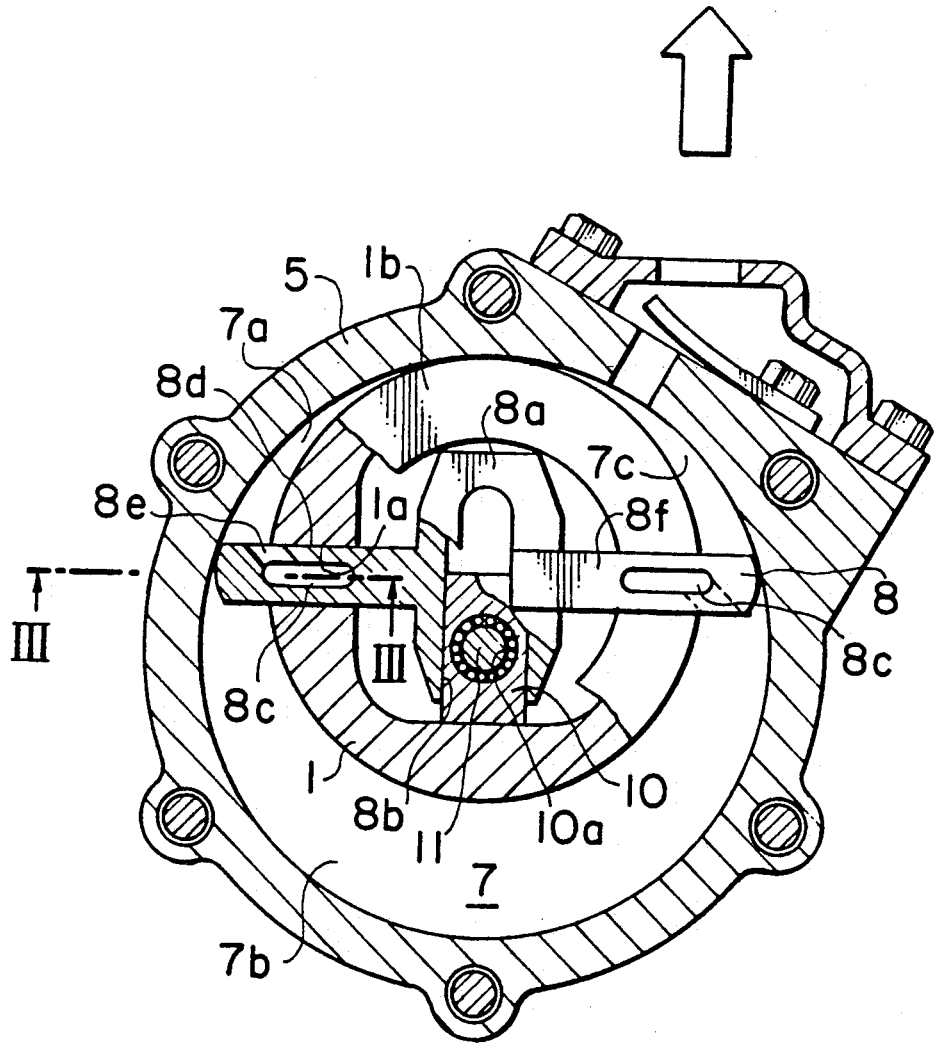
FIG. 1 is a crosssectional view of a rotary compressor of variable displacement type according to an embodiment of the present invention.
Figure 2:
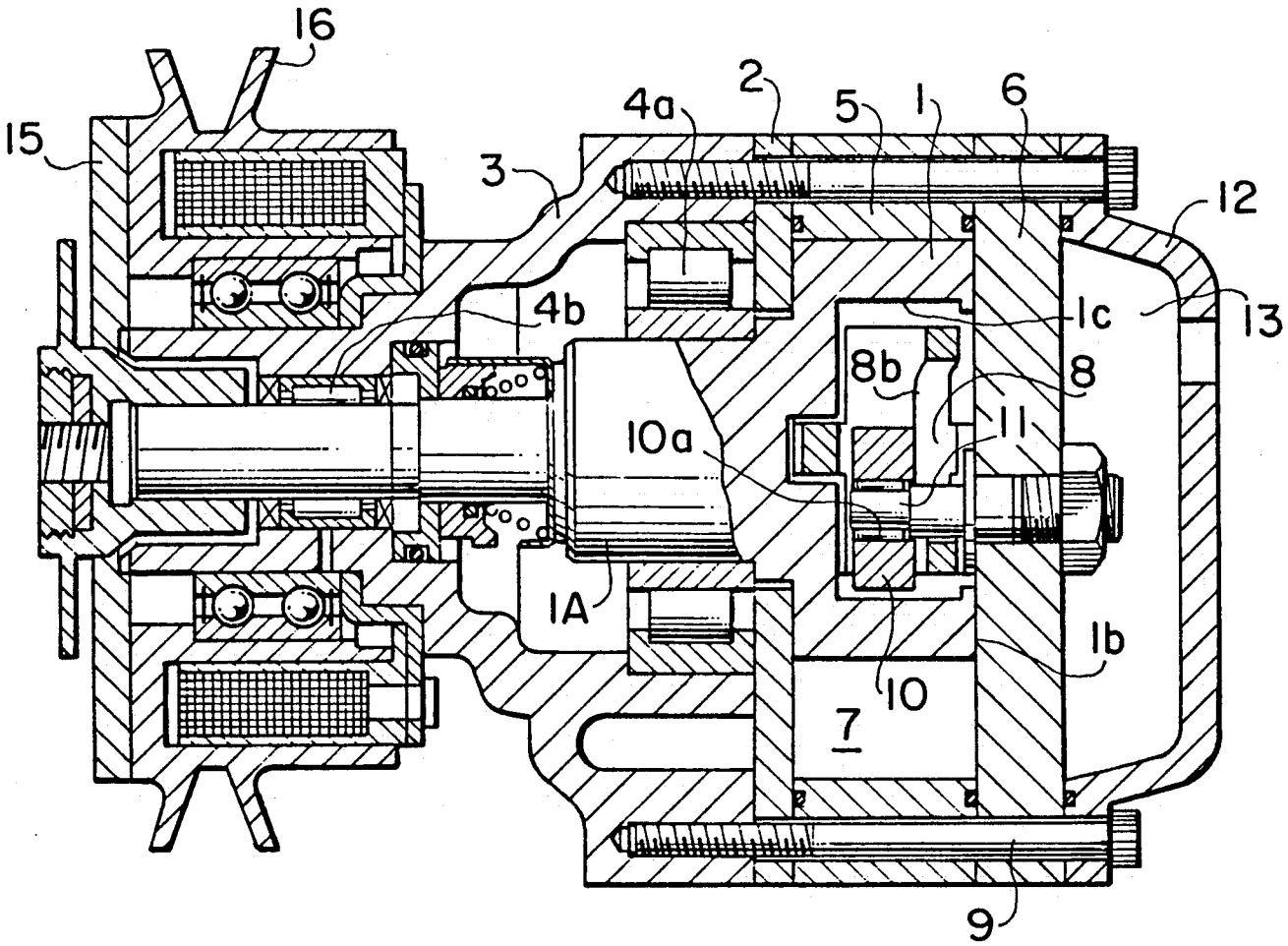
FIG. 2 is a longitudinal sectional view of the same compressor.

As shown in FIGS. 1 and 2, according to the present invention, a rotor 1 has an integrally formed shaft 1A, and a pair of vane grooves 1*a* penetrating through the rotor 1 at positions circumferentially spaced apart from each other by 180 degrees. The rotor shaft 1A extends from one end surface of the rotor 1, and through the other end surface 1*b* of the rotor 1 formed with a large recess 1*c* extending from the middle portion of the end surface 1*b* toward the inside of the rotor.

The rotor shaft 1A is rotatably supported by two bearings 4*a*, 4*b* which are spaced apart from each other and disposed on an inner surface of a front cover 3 arranged adjacent to one of side plates or a front plate 2.

The front plate 2, a cylinder 5, and the other side plate or a rear plate 6 are axially stacked one upon another, and define a working space 7 in cooperation with the outer surface of the rotor 1.

The working space 7 is divided into three working spaces 7*a*, 7*b*, and 7*c* by a vane 8, which is received in the vane grooves 1*a* of the rotor 1.

A rear cover 12 is provided on the rear side of the rear plate 6, and the rear cover 12, rear plate 6, cylinder 5, front plate 2, and front cover 3 are clamped together by a bolt 9. A low pressure suction chamber 13 is defined between the rear plate 6 and the rear cover 12.

The vane 8 includes a projection 8*a* at a longitudinally middle portion thereof, which is accommodated in the internal space or the recess 1 of the rotor 1, and the projection 8*a* is formed with a cylindrical sliding surface 8*b* extending in a direction substantially perpendicular to the longitudinal direction of the vane 8 or the vane grooves 1*a*.

A slider 10 is disposed within the projection 8*a* in a manner to make sliding contact with the sliding surface 8*b*, and is permitted to reciprocate along this surface 8*b*. The slider 10 includes at its middle portion a bearing 10*a* which supports a slider pin 11 extending from the rear plate 6 in a cantilever-fashion, thereby allowing the slider 10 to rotate around the slider pin 11.

The slider pin 11 has an axis parallel to the rotational axis of the rotor shaft 1A and radially spared from the same, and is secured to the rear plate 6.

The inner surface of the cylinder 5 is shaped to have a contour substantially equal to the locus drawn by the tips of the vane 8 when the latter is rotated, and a fine clearance is maintained therebetween for assuring an oil film sealing.

Figure 3:
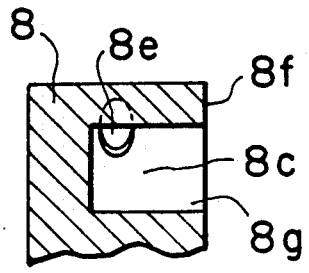
FIG. 3 is a sectional view taken along line III—III of FIG. 1.

As shown in FIGS. 1 and 3, the vane 8 is formed with suction passages 8*c* having a depth smaller than the plate thickness of the vane 8. Each suction passage 8*c* has at one end thereof, an aperture 8*e* opening to a rotationally rear surface 8*d* of the vane 8 contacting with the vane groove 1*a* of the rotor 1, and at the other end thereof, an opening part 8*g* opening at a rear side surface 8*f* of the vane 8 making sliding contact with the rear plate 6.

Figure 4:
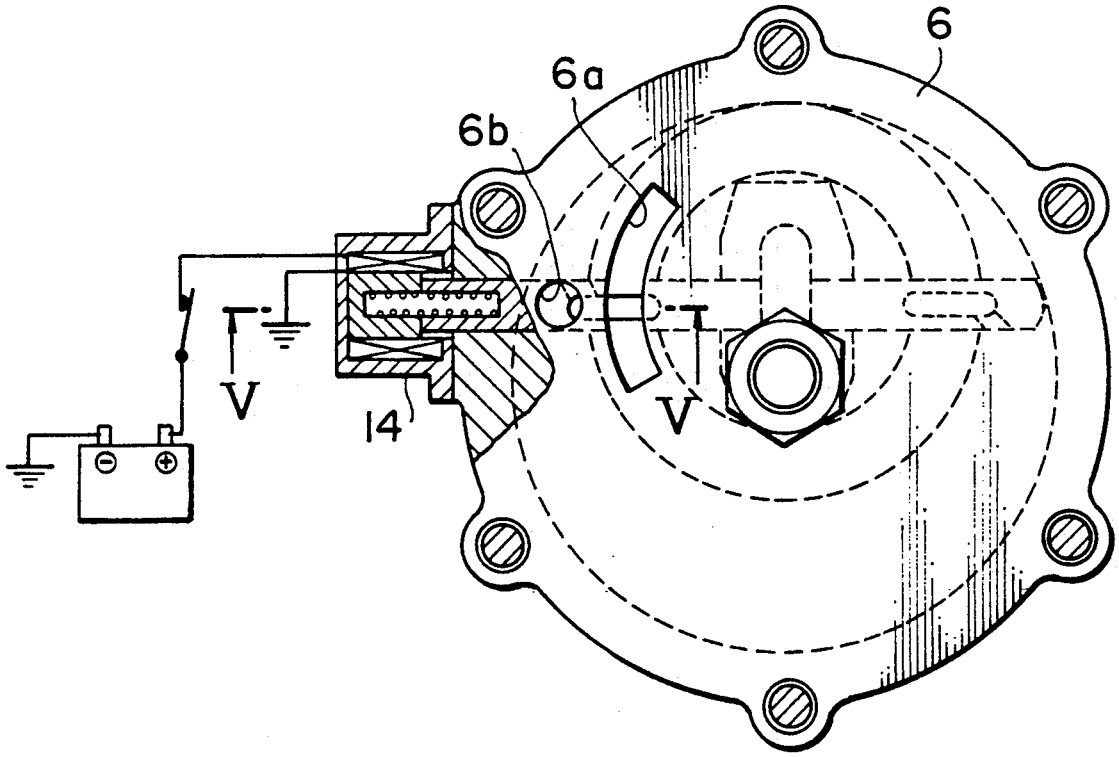
FIG. 4 is a side view partly in section which is viewed from the rear plate side and shows first and second suction ports and a solenoid valve for opening and closing the second suction port.

The rear plate 6 is formed, as shown in FIG. 4, with a first suction port 6*a*, which overlaps with the opening 8*g* of the suction passage 8*c* in a predetermined angular range, and penetrates the rear plate 6 from a side surface thereof adjacent to the suction chamber 13 to the other side surface adjacent to the end surface 1*b* of the rotor 1.

The rear plate 6 is further formed with a second suction port 6*b*, which penetrates the rear plate 6 and opens at its one end to the suction chamber 13 and at the other end to the working space 7. The second suction port 6*b* is so located that a communication with the working space 7 can be maintained until a maximum volume of the space has been reached (as indicated in FIG. 1 with numeral 7*b*). Further, as shown in FIGS. 4–7, the second suction port 6*b* has a construction which makes it possible to establish or interrupt the communication between the suction chamber 13 and the working space 7 by means of a solenoid valve 14. The breadth of the second suction port 6*b*, measured in the rotational direction of the rotor 1, is determined to be smaller than the thickness of the vane 8 for preventing two working spaces divided by the vane 8 from communicating with each other through the suction port 6b. It is possible to provide a plurality of second suction ports 6b for reducing suction resistance.

An electromagentic clutch 15 is provided on an end of the rotor shaft 1A remote from the rotor 1. When the clutch 15 is in the "ON" state, a driving force is transmitted from a pulley 16.

Figure 5:
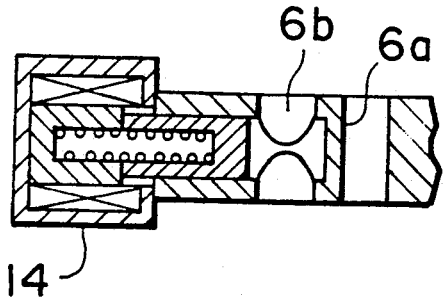
FIG. 5 is a sectional view taken along line V V of FIG. 4.
Figure 6:
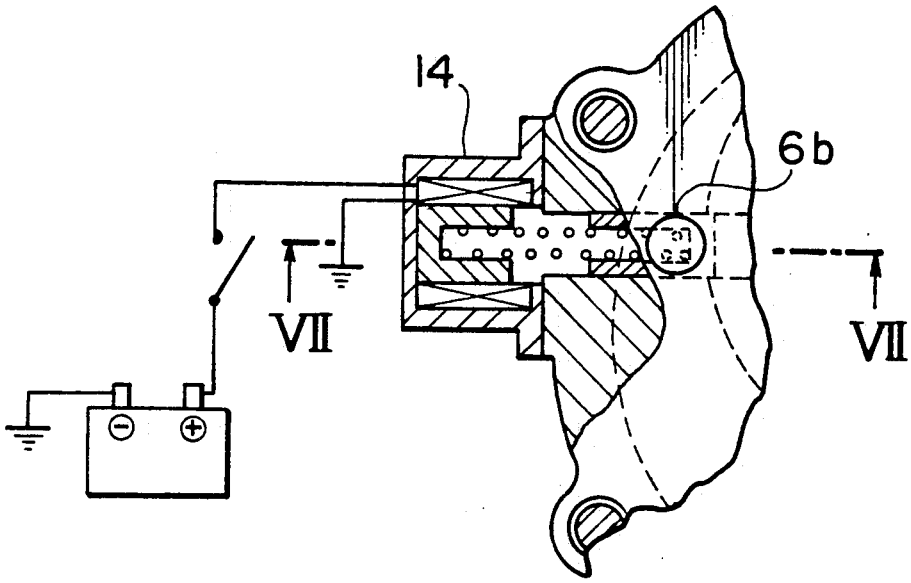
FIG. 6 is a sectional view showing the solenoid valve in a OFF, state, and the section suction port in a 'close' state.
Figure 7:
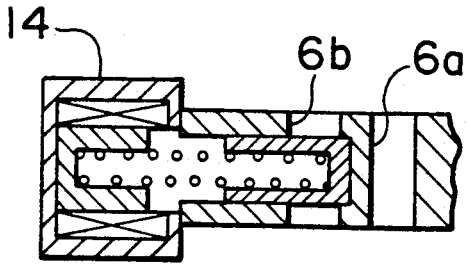
FIG. 7 is a sectional view taken along line VII—VII of FIG. 6.
Figure 8:
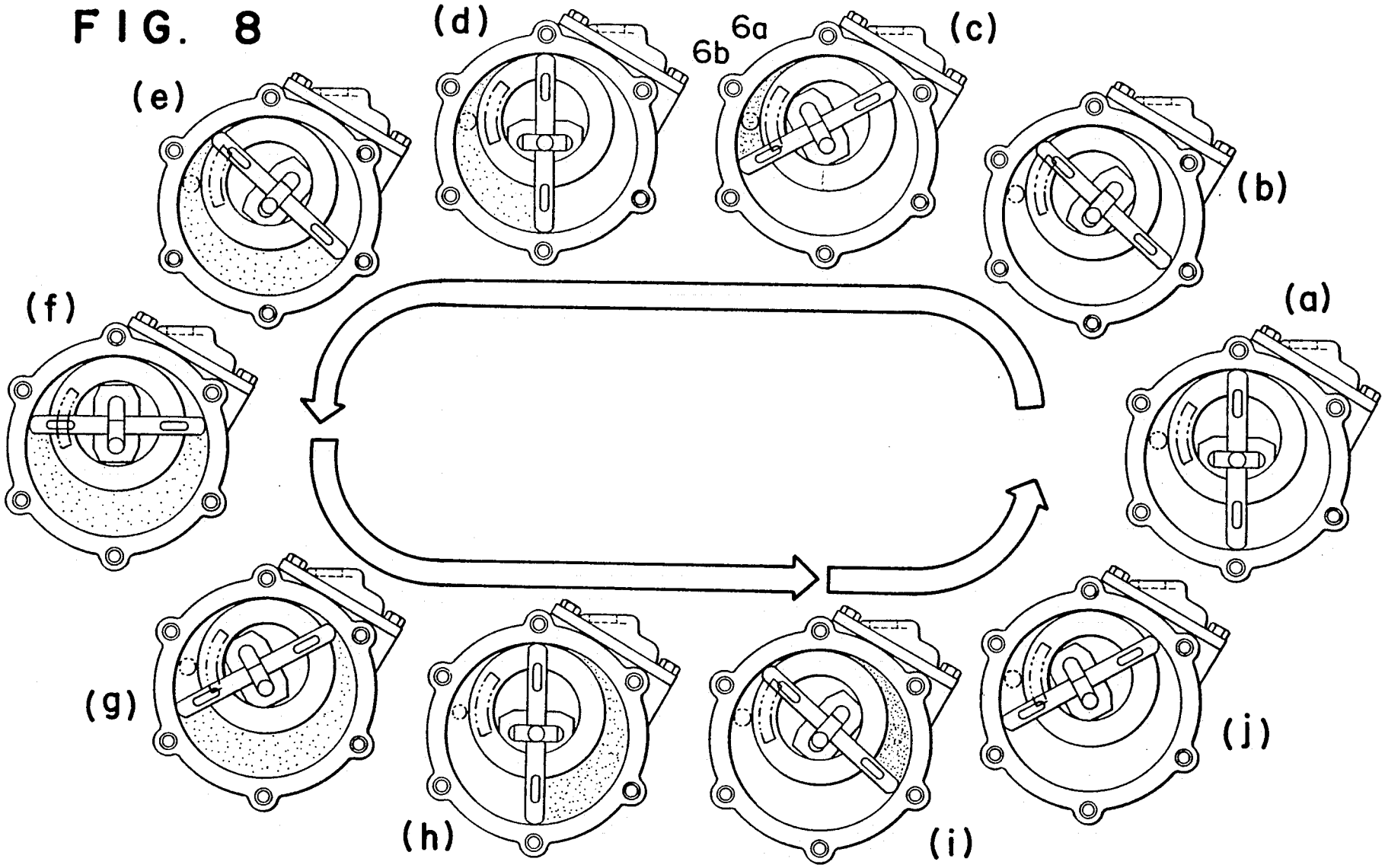
FIG. 8 is an illustrative view for explaining a maximum displacement operation of the compressor.

When electric current is supplied to the solenoid valve 14 with the second suction port 6b maintained in an open state as shown in FIGS. 4 and 5, the compressor performs, as shown in FIG. 8, a suction stroke from a state (b) shown in FIG. 8 to a state (f) of maximum volume where the second suction port 6b is closed by a portion of the vane 8 located on the rear side of the working space, and then compression and exhaust strokes follows, thereby assuring a maximum compression volume or displacement.

Figure 9:
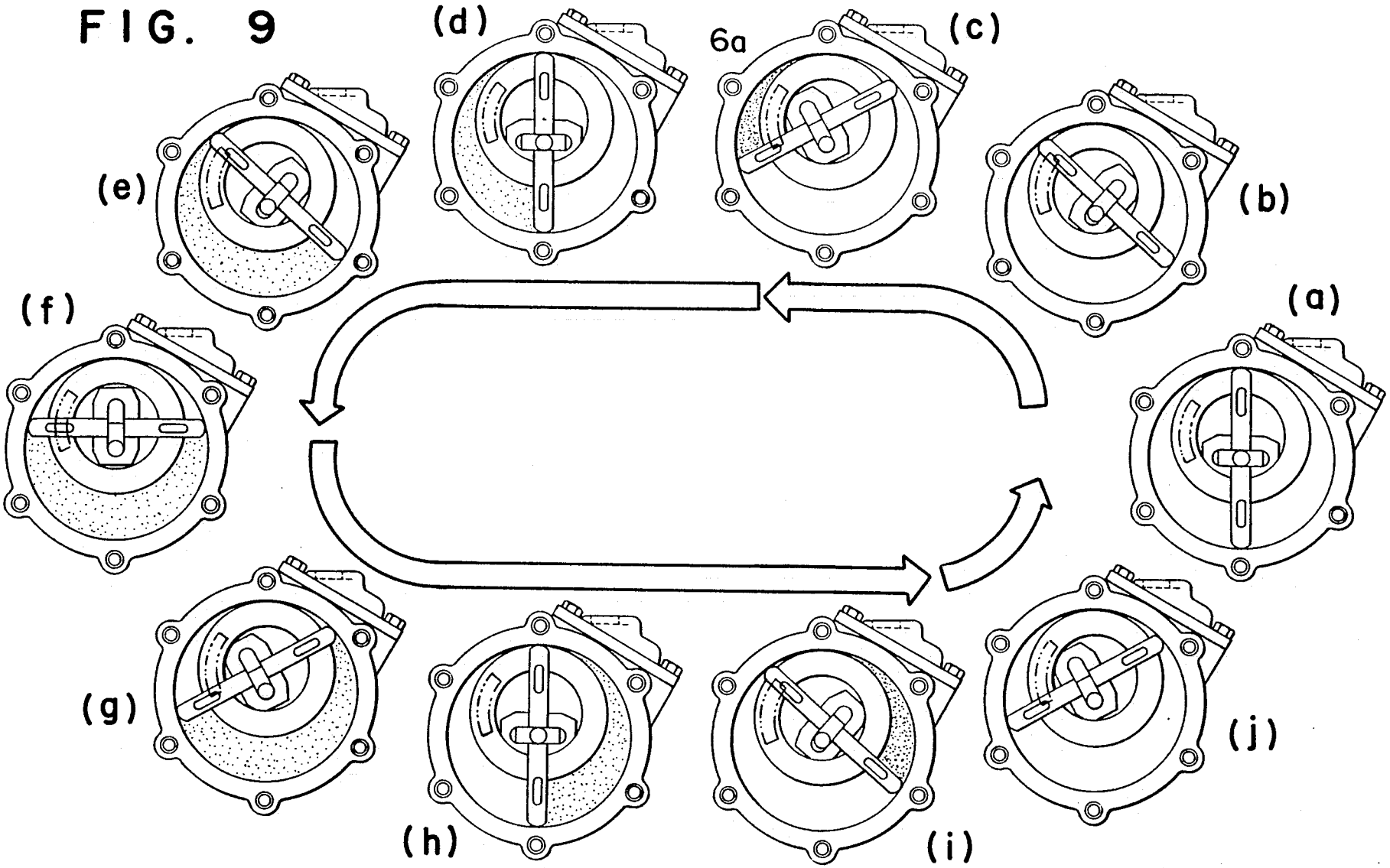
FIG. 9 is an illustrative view for explaining a limited displacement operation of the compressor.

On the other hand, when an electric current supply to the solenoid valve 14 is interrupted and the second suction port 6b is brought to a "close" state, the compressor performs, as shown in FIG. 9, a suction stroke from a state (b) to a state (c) where the first suction port 6a communicates with the suction passage 8c of the vane, and thereafter, an adiabatic expasion in a closed space is carried out until the state (f). Thereafter, the compression and exhaust stroke are performed. Since the suction stroke is performed only until reaching the state (c), the exhaust volume or displacement of the compressor is significantly decreased in comparison with the case of FIG. 8.

As mentioned above, in this embodiment, it is possible to vary an exhaust volume of the compressor by an on or off switching of the solenoid valve 14.

In this embodiment, the minimum exhaust volume can be decreased as compared with the case where the inlet port is opened to the inner peripheral surface of the cylinder (housing) as proposed in Japanese Utility Model Unexamined Publication No. 57-58791, resulting in a wider control range for the exhaust volume.

Figure 10A:
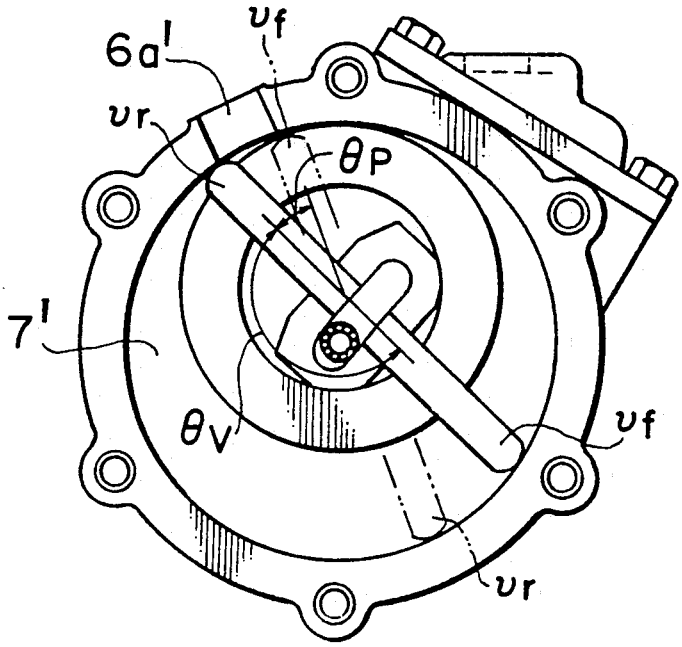
FIG. 10A PRIOR ART
FIG. 10A is an illustrative view for explaining a volume control range according to the prior art.

Namely, as shown in FIG. 10A, it is possible to finish suction stroke before the volume of the working space becomes maximum, even in the case where the first suction port 6a' is opened to the inner peripheral surface of the cylinder or to a surface of the side plate which is exposed to the working space. In this case, however, the suction stroke starts when a front vane vf reaches the starting edge or rear edge of the suction port 6a' as indicated by two-dot chain lines, while it finishes when a rear vane vr has passed the ending edge or front edge of the suction port 6a' as indicated by solid lines. Accordingly, denoting the angle of opening area of the suction port 6a' with respect to the rotation center of the rotor by $\theta p$, and the angle between the vanes vf and vr (i.e. the pitch angle in a circumferential direction of the vanes) by $\theta v$, the suction stroke is carried out in an angular range of $\theta p + \theta v$. Although it is possible to somewhat decrease the opening angle $\theta p$ of the suction port 6a', it is impossible to change the vane circumferential pitch angle $\theta v$. Consequently, the suction stroke is performed in the range of at least the angle $\theta v$, and the minimum volume of the working space can not be made smaller than that determined by the angle $\theta v$ (the volume being indicated by numeral 7' in FIG. 10A). Thus, the volume control range is narrower.

Figure 10B:
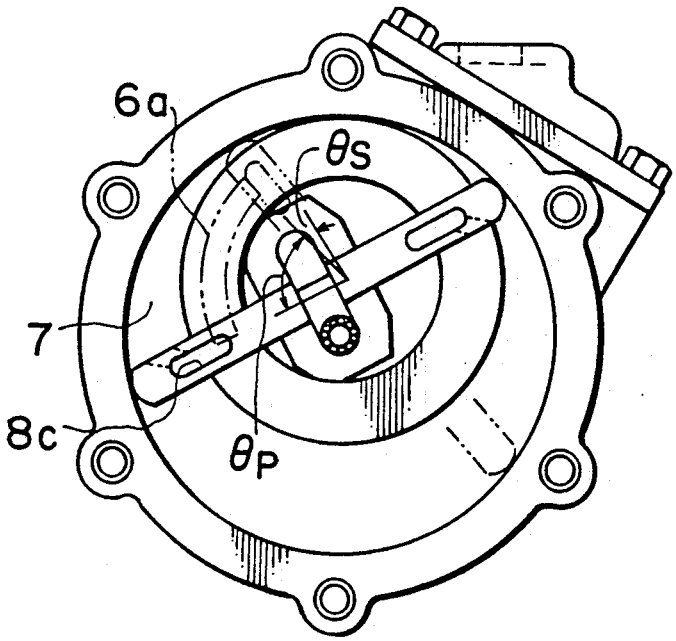
FIG. 10B is an illustrative view for explaining a volume control range according to the invention.

On the other hand, in the above described embodiment, a suction stroke starts when the opening 8g of the suction passage 8c initiates to communicate with the suction port 6a of the rear plate or side plate 6, as indicated by two-dot chain lines in FIG. 10B, while it finishes when the communication has been cut off as indicated by solid lines. Accordingly, denoting the angle of the opening 8g of the suction passage with respect to the rotation center of the rotor by $\theta s$, and the opening angle of the suction port 6a by $\theta p$, the suction stroke is carried out in an angular range of $\theta s + \theta p$ as measured in a direction of the rotor rotation. The opening angle $\theta s$, which corresponds to the width of the opening 8g of the suction passage 8c measured on the surface of the vane contacting with side plate 6, can be made sufficiently small as compared with, the vane circumferential pitch angle $\theta v$. Consequently, the range of the suction stroke, $\theta s + \theta v$, can be made significantly small by sufficiently decreasing the opening angle $\theta p$ of the first suction port 6a, as indicated by numeral 7 in FIG. 10B. Thus, in controlling the volume to be discharged the minimum volume or displacement of lower level can be attained and hence a wide range of volume control can be effected.

Further, in the above-described embodiment, the communication between the suction passage 8c and the working space 7 is interrupted just after a compression stroke starts as shown by (g) in FIG. 8, since the aperture 8e of the suction passage 8c is moved or drawn into the interior of the rotor 1 together with the vane 8. As a result, in a compression stroke in the working space 7, the high pressure working gas is prevented from leaking into the suction passage 8c and causing an internal leakage of gas into the lower pressure side in the next suction stroke.

Figure 11:
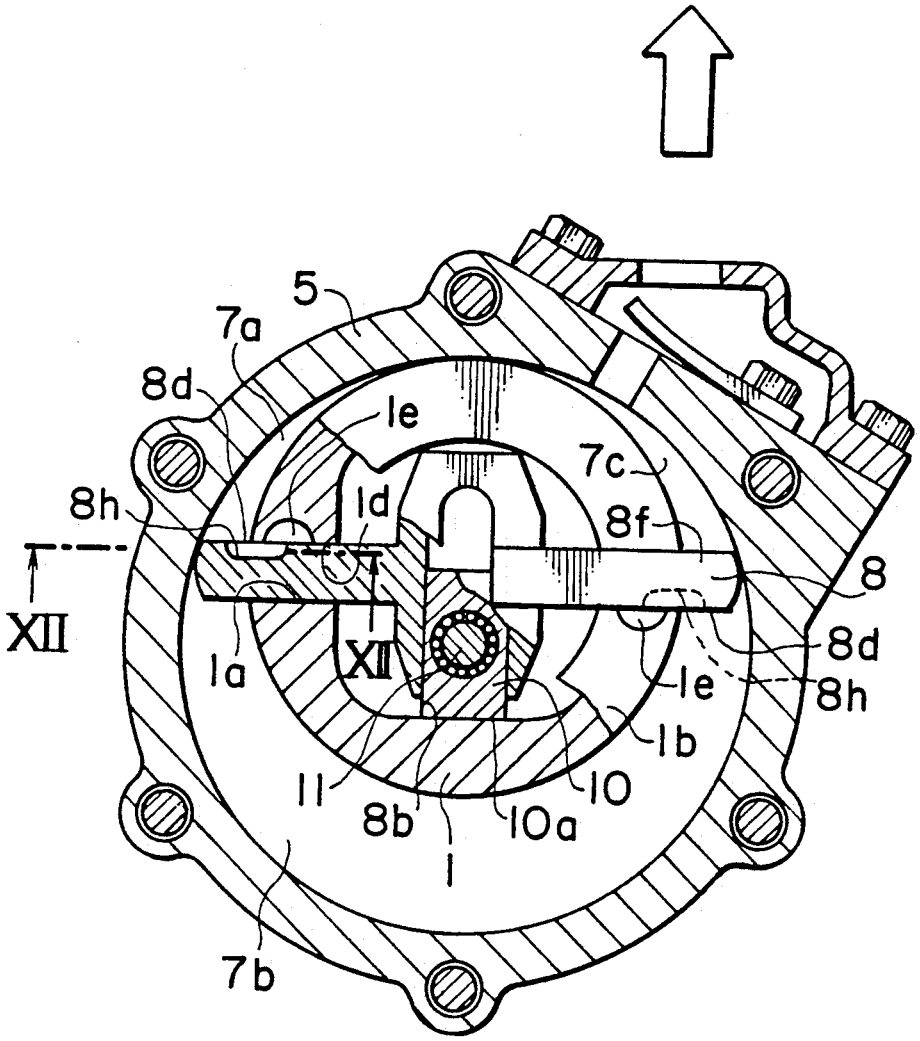
FIG. 11 is a rotary compressor of variable displacement type according to a second embodiment of invention.
Figure 12:
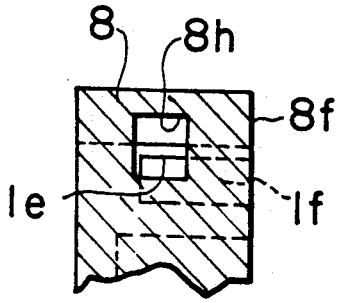
FIG. 12 is a sectional view taken along line XII—XII of FIG. 11.

Next, a second embodiment of the invention will be described by referring to FIGS. 11–13. In the first embodiment, the suction ports 8c for providing a communication between the first suction port 6a and the working space is formed only in the plate thickness of the vane 8. The second embodiment is different from the first embodiment in this point. Namely, in the second embodiment, a vane 8 is formed with grooves 8h in a rotationally rear surface 8d of the vane which makes sliding contact with one of the surfaces of each rotor groove 1a, with the grooves 8h constituting openings of a suction passage communicating with the working space. Further, the rotor 1 has axially extending grooves 1e formed in a surface 1d of each vane groove 1a which is in contact with the sliding surface 8d of vane 8. Each axial groove 1e has an opening portion 1f opening at a rear end surface 1b of the rotor 1 which makes sliding contact with the side plate or the rear plate 6, and forms a part of the suction passage.

Figure 13:
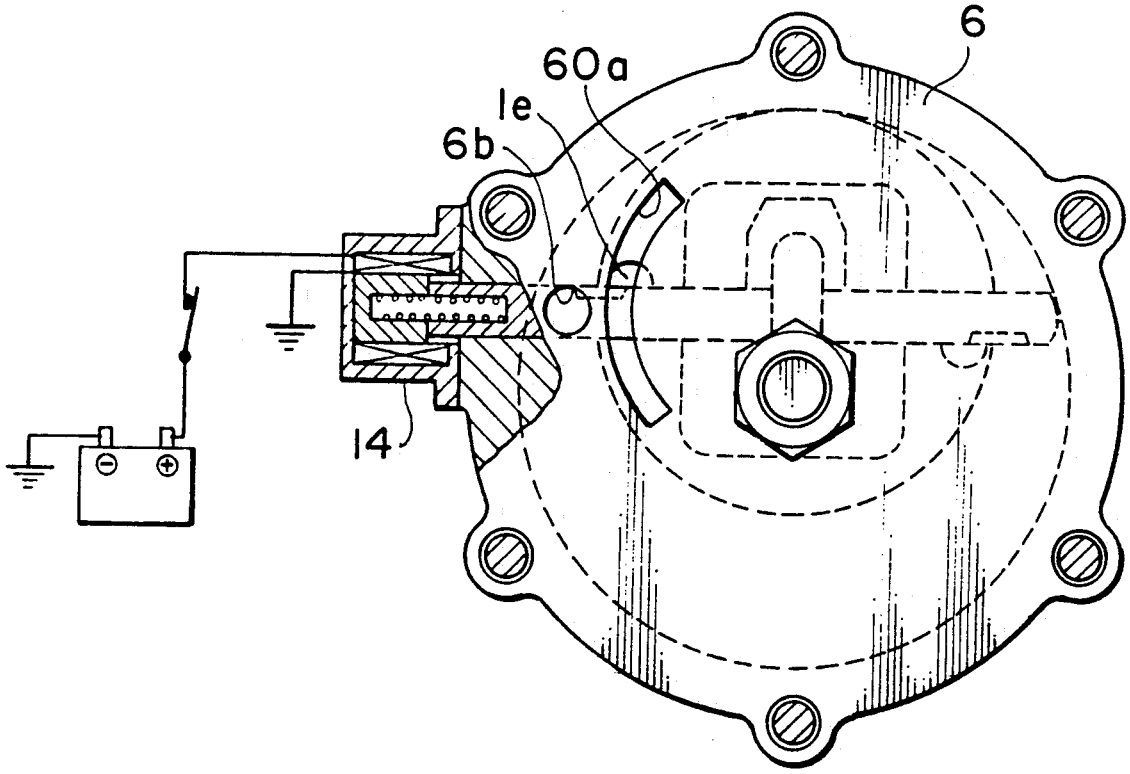
FIG. 13 is a side view of a compressor according to the second embodiment partly in section which is viewed from the rear plate side and shows first and second suction ports and a solenoid valve for opening and closing the second suction port.

On the other hand, rear plate 6 is formed, as shown in FIG. 13, with a first suction port 60a penetrating the rear plate 6 from a suction chamber (not shown) to a surface of the plate 6 making a sliding contact with the end surface of the rotor. First suction port 60a extends circumferentially so as to overlap with the rear end opening 1f of the axial groove 1e of the rotor 1 in a predetermined angular range in a rotational direction of the rotor.

Further, as shown in FIG. 13, there is formed a second suction port 6b, which is controlled to open or close by a solenoid valve 14 similarly to the first embodiment.

In the second embodiment, when the second suction port 6b is in a closed state, the suction stroke in the working space is carried out only in a positional range where the groove 8h and the groove 1e each forming a part of the suction passage overlap with each other and the rear end opening 1*f* of the groove 1*e* overlaps with the first suction port 60*a* of the rear plate 6, thereby performing a partial load operation. The principle in controlling the volume is similar to that of the first embodiment described by referring to FIGS. 6–9. In this embodiment, however, since it is not required to provide the openings 8*g* in the rear end surface of the vane 8, there is no deterioration in sealing performance is caused, which may be possibly caused by a substantially decreased vane thickness due to the provision of the openings 8*g*. Thus, a volume control function may be achieved without lowering the cooling capacity of the compressor in a full load condition.

Next, a third embodiment of the invention will be described by referring to FIGS. 14–18. In the first embodiment, the rear plate 6 is formed with a second suction port 6*b* which opens at a side surface of the plate 6 directly exposed to the working space 7, and this second suction port can be switched to open or close for controlling the volume in two steps. In the third embodiment, a multi-step volume control can be achieved by an arrangement different from that of the first embodiment.

Figure 14:
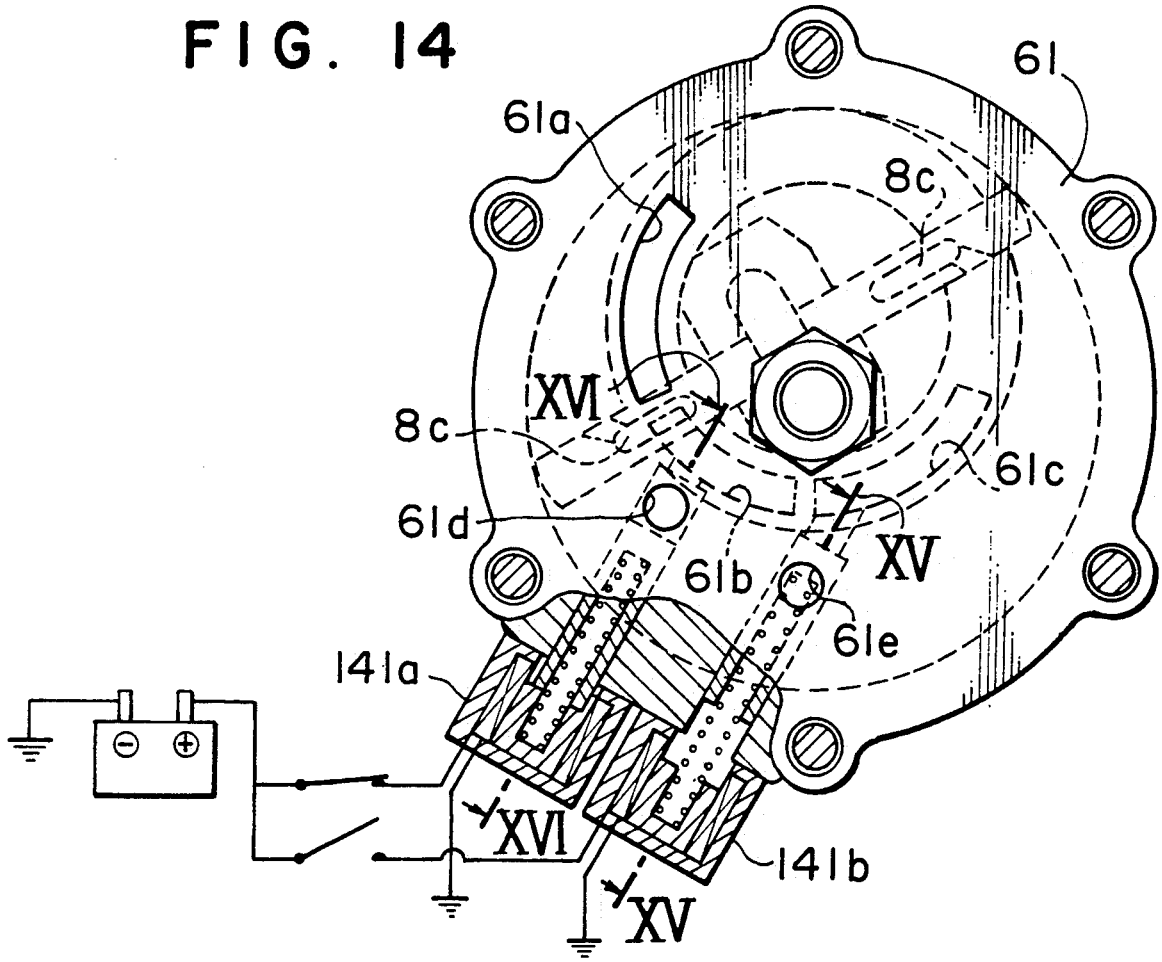
FIG. 14 is a side view of a compressor according to a third embodiment of the invention viewed from the rear plate side.
Figure 15:
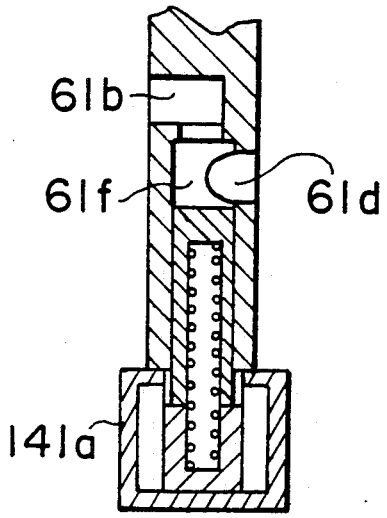
FIG. 15 is a sectional view taken along line XV—XV of FIG. 14.
Figure 16:
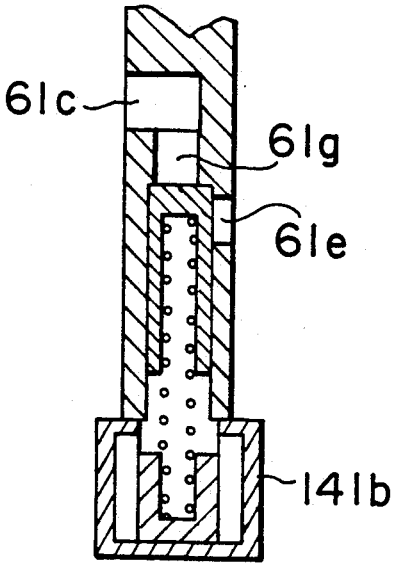
FIG. 16 is a sectional view taken along line XVI—XVI of FIG. 14.

In the third embodiment, a rear plate or side plate 61 includes a first suction port 61*a*, a second suction port 61*b* and a third suction port 61*c* arranged circumferentially one behind another and each opening at the rear plate surface contacting with the rotor 1. The first suction port 61*a* also opens at the rear plate surface on the suction room chamber side and communicates with the low pressure suction room 13 at all times, while the second and third suction ports 61*b*, 61*c* do not directly open to the suction room but communicate with the suction room 13 only through passages 61*f* and 61*g*, respectively, the passages 61*f* and 61*g* opening to the suction room 13 through opening portions 61*d* and 61*e*, respectively. The passages 61*f*, 61*g* are opened or closed by solenoid valves 141*a*, 141*b*. The states of the solenoid valves 141*a* and 141*b* in FIG. 14 are as shown in FIGS. 15 and 16, respectively. Namely, the solenoid valve 141*a* is in an electric current "ON" state, and the solenoid valve 141*b* is in an electric current 'OFF' state, and accordingly, the second suction port 61*b* is in an 'open' state and the third suction port 61*c* is in a 'close' state. Similarly to the second suction port 6*b* of the first embodiment shown in FIG. 4, these suction ports of the third embodiments are so located as to have no direct communication with the working space 7. Further, the third suction port 61*c* is so arranged as to maintain communication with the suction passage 8*c* of the vane 8 until the volume of the working space becomes maximum.

Figure 17:
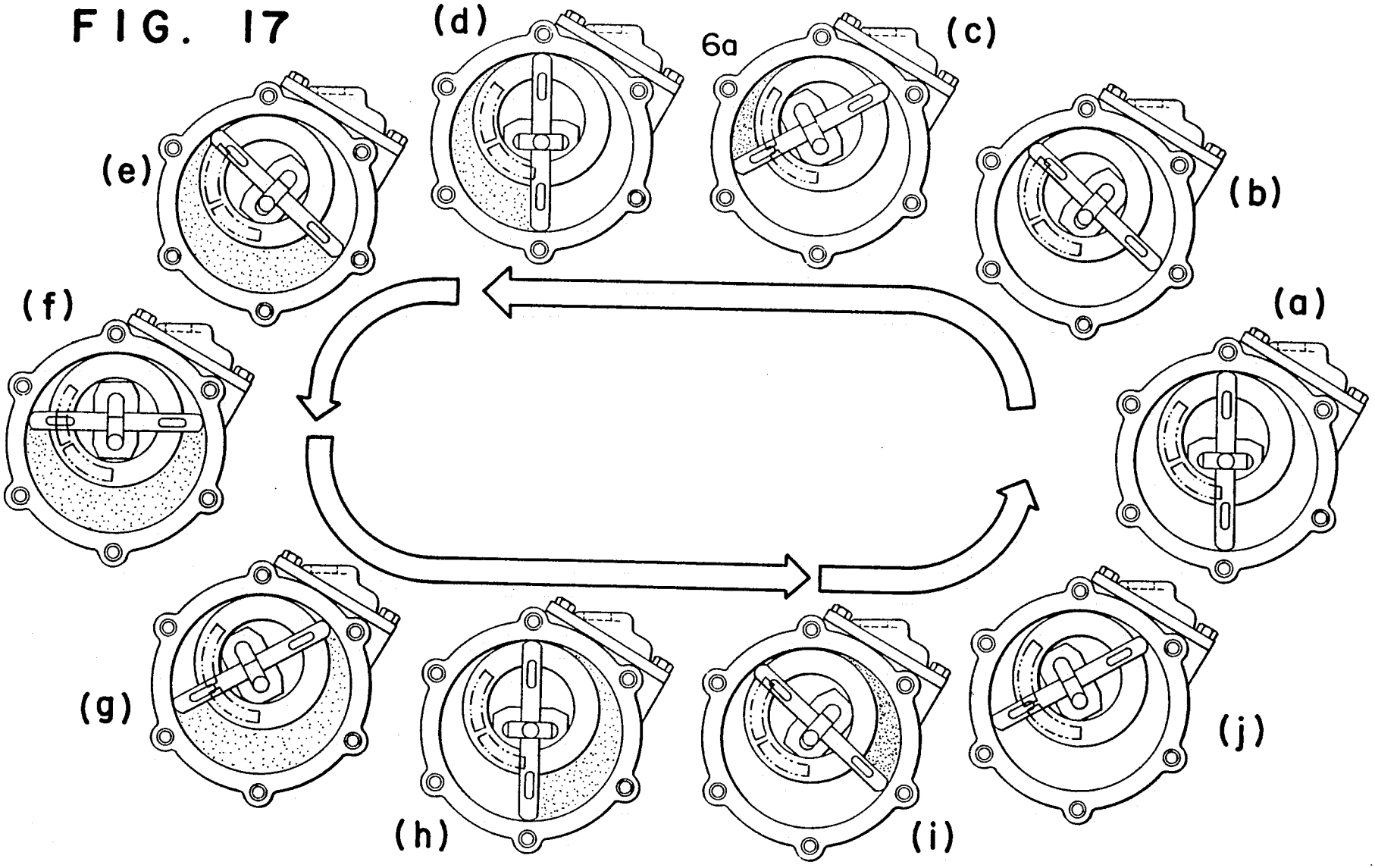
FIG. 17 is an illustrative view for explaining an intermediate displacement operation of the compressor according to the third embodiment.

FIG. 17 shows an operation of the compressor when the latter is in a state shown in FIG. 14. The first suction port 61*a* or the second suction port 61*b* communicates with the suction passage 8*c* of the vane 8 from a state (b) to a state (d) for performing a suction stroke, and then an expansion stroke is performed in a closed state until a state (f) corresponding to the maximum volume is reached. Thereafter, a compression stroke and an exhaust stroke follow.

Figure 18:
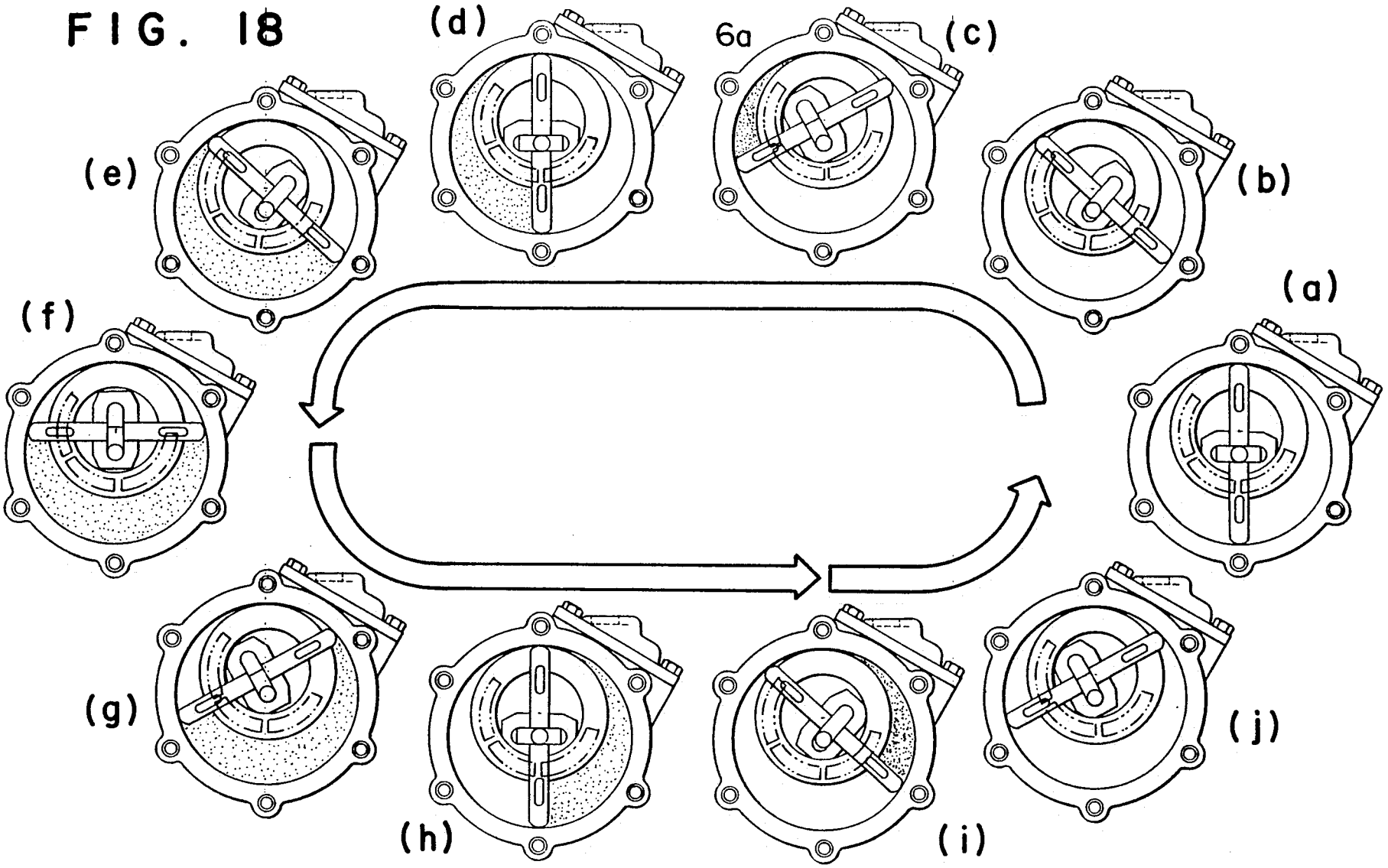
FIG. 18 is a similar illustrative view for explaining a maximum displacement operation of the compressor according to the third embodiment.

FIG. 18 shows an operation of the compressor which is in a state where both of the solenoid valves 141*a* and 141*b* are energized or in an 'ON', condition, and the first, second and third suction ports 61*a*, 61*b* and 61*c* are all communicating with the suction chamber 13. A suction stroke is performed from a state (b) to a state (f) corresponding to the maximum volume, and thereafter a compression stroke and an exhaust stroke follow. In this case, a maximum exhaust volume is obtained.

Further, in the case where the solenoid valve 141*a* in FIG. 14 for opening and closing the second suction port 61*b* is also de-energized or made 'OFF' and the first suction port 61*a* alone communicates with the suction room 13, the compressor is operated in the same manner as that shown in FIG. 9. In this case, the suction stroke is achieved only from the state (b) to the state (c), resulting in a minimum exhaust volume of the compressor.

As mentioned above, according to the third embodiment, the volume of the compressor can be varied in three steps.

A fourth embodiment of the invention is described below by referring to FIGS. 19–22. In this embodiment, the volume control of the compressor is achieved continuously or steplessly.

Figure 19:
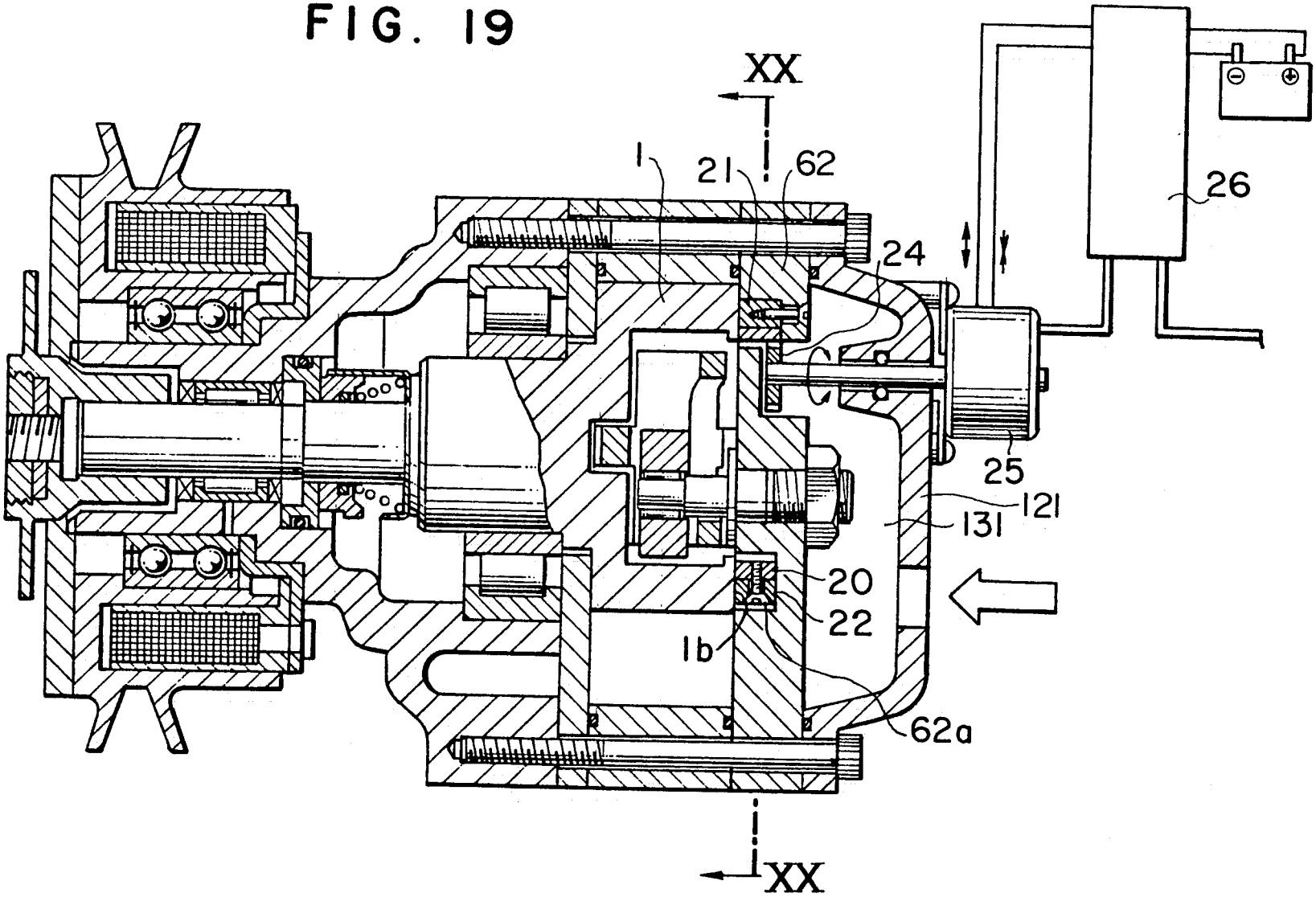
FIG. 19 is a longitudinal sectional view of the compressor according to a fourth embodiment of the invention.
Figure 20:
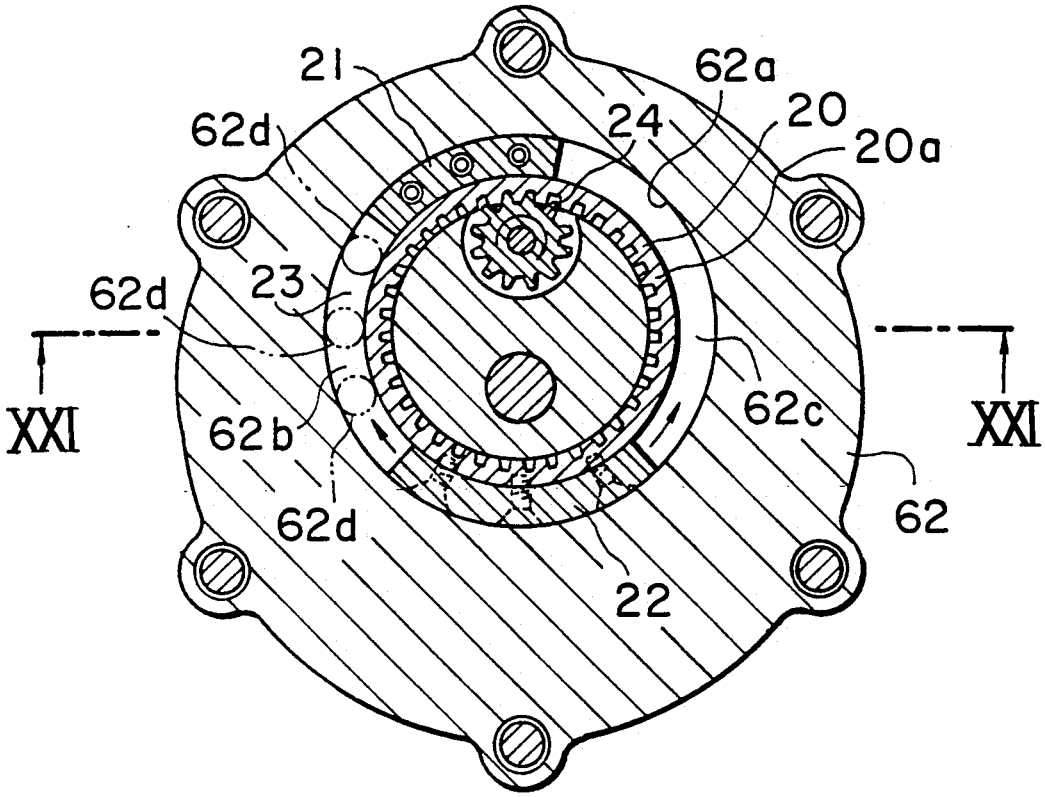
FIG. 20 is a sectional view taken along line XX—XX of FIG. 19.
Figure 21:
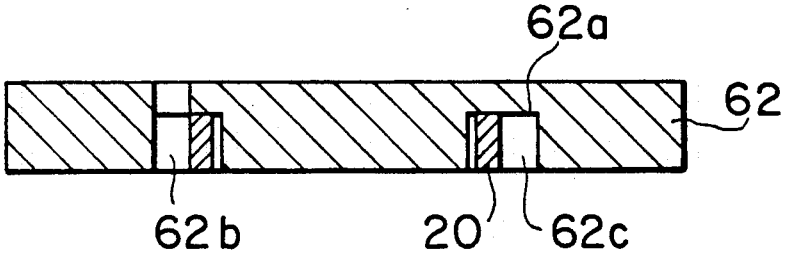
FIG. 21 is a sectional view taken along line XXI—XXI of FIG. 20, FIGS. 22A, 22B, and 22C are illustrative views for explaining a minimum volume operation, an intermediate volume operation and a maximum volume operation, respectively, of the compressor according to the fourth embodiment.

The compressor shown in FIG. 19 is the same as that of the first embodiment with respect to the structure located on the front side (left side in the figure) of the rear plate 62. The rear plate 62 in the fourth embodiment is formed with a ring-like groove 62*a* in a surface thereof on which an end surface lb of the rotor 1 slides. In this groove 62*a* is inserted a ring-like member 20 with its inner circumferential surface mounted on the inner circumferential surface of the groove. The thickness of the ring-like member 20 is substantially equal to the depth of groove 62*a*, and the outer diameter of the member 20 is smaller than the outer diameter of the groove 62*a*, thereby forming a ring-like space between the outer circumferential surface of the member 20 and the outer circumferential surface of the groove 62*a*. This ring-like space is divided into two spaces 62*b* and 62*c* by two partition members 21 and 22 which are screwed secured to the rear plate 62 and the ring-like member 20, respectively, by bolts. To the ring-like member 20 is secured a stopper pin 23, which limits the rotation angle of the ring like member 20 in one direction.

The ring-like member 20 is formed with gear teeth 20*a* on the inner peripheral surface thereof. A pinion gear 24 meshes with the gear teeth 20*a* and is rotationally driven by a servo-motor 25 located outside of a rear cover 121.

The divided space 62*b* defined by the front end surface (as viewed in the rotational direction of the rotor 1) of the partition member 21 fixed to the side plate 62 and the rear end surface of the partition member 22 rotatable together with the ring-like member 20 communicates with a suction chamber 131 through a plurality of communication holes 62*d* at all times. The other divided space 62*c* does not communicate with the suction chamber 131.

Figure 22C:
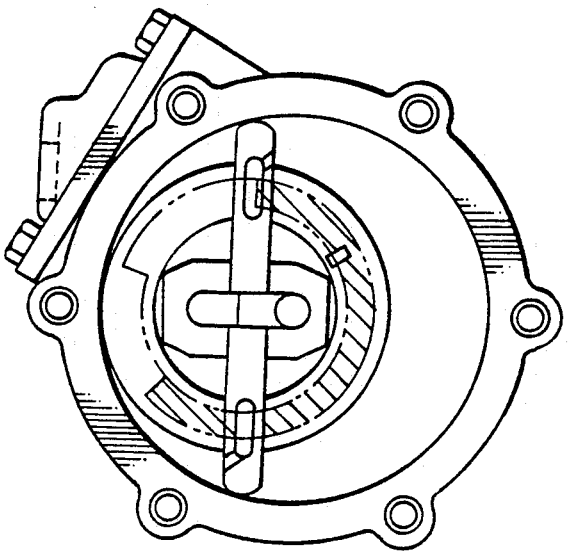
Figure 22B:
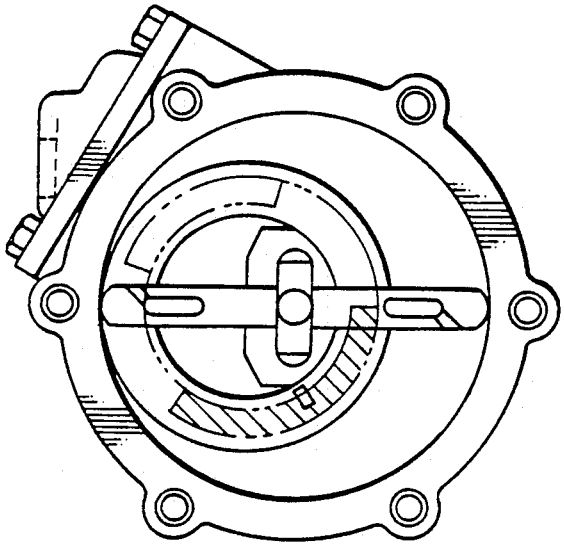
Figure 22A:
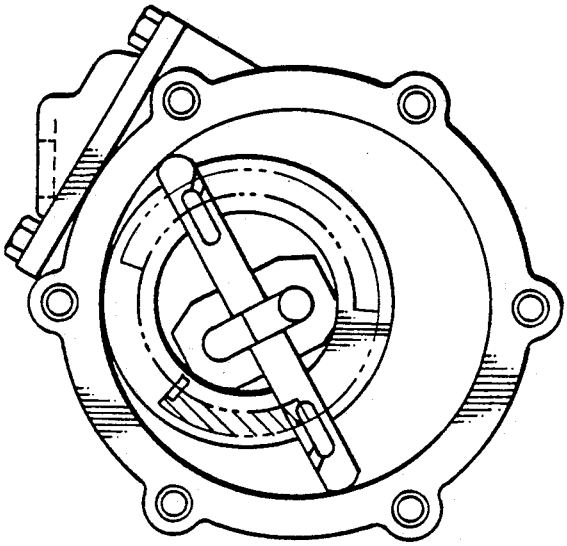

The circumferential length of the space 62*b* can be changed by rotating the ring-like member 20 and the partition member 22 integrated with the member 20 as shown in FIGS. 22A, 22B and 22C. As a result of this length change, the volume to be suctioned into the working space can be continuously changed.

The operations of the compressor in the states shown in FIGS. 22A, 22B and 22C are substantially identical with those shown in FIGS. 9, 17 and 18, respectively.

The servo-motor 25 for driving the ring-like member 20 and the partition member 22 is controlled by a controller 26 based on an evaporator fin temperature, a refrigeration cycle signal indicating an operational state of refrigeration cycle such as suction pressure, and a positional signal showing a position of the volume control means.

According to the fourth embodiment, the volume can be changed continuously.

Figure 23:
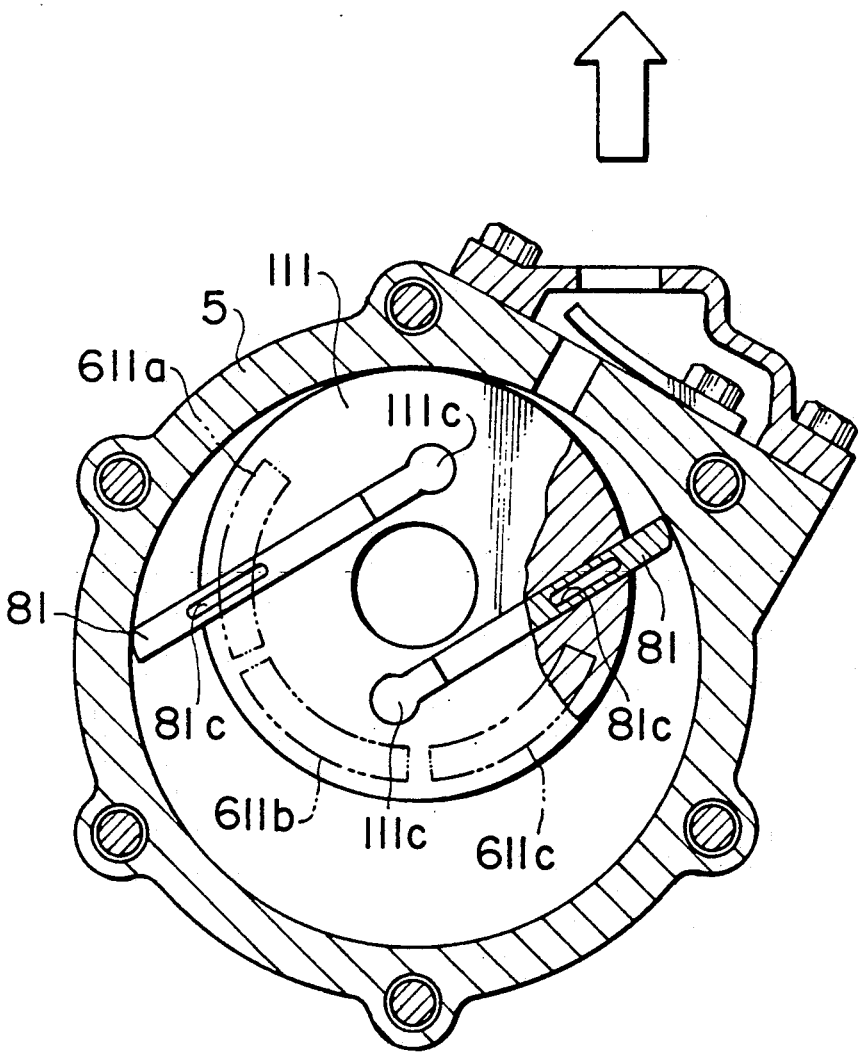
FIG. 23 is a sectional view of the main portion of the compressor according to an embodiment of the invention in which the invention is applied to a rotary vane compressor of a different type.
Figure 24:
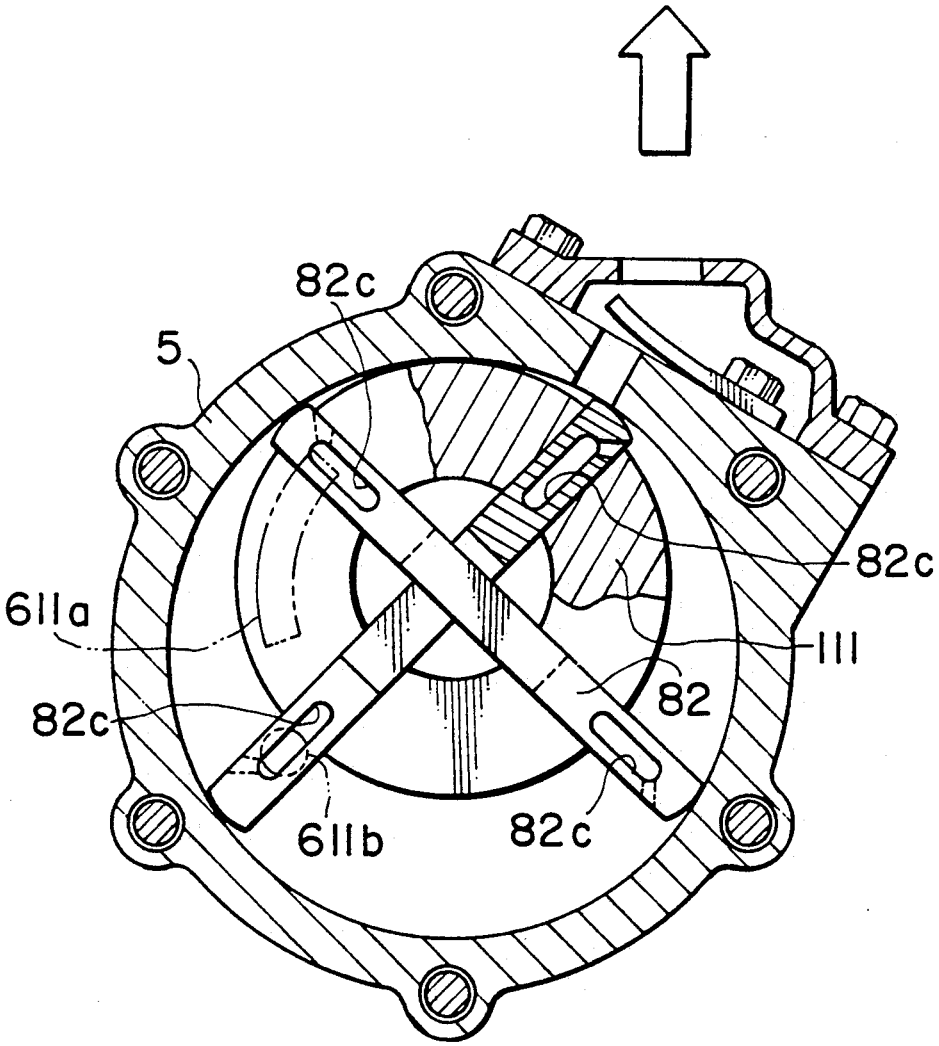
FIG. 24 is a sectional view of the main portion of the compressor according to an embodiment of the invention in which the invention is applied to a rotary vane compressor of a further different type.

Although, in the above described embodiments, the invention is applied to rotary vane compressors including a rotor of cantilever type and a vane penetrating the rotor, the invention may also be applied to compressors of different types As shown, for example, in FIGS. 23 and 24.

In the embodiment shown in FIG. 23, the rotary compressor includes two vanes 81, each of which does not penetrate (or extend through) the rotor 111, and two grooves in the rotor each having a bottom chamber 111*c* at one end thereof. The back pressure in the bottom chambers 111*c* push the vanes towards the outside of the rotor and bring the vanes into contact with the cylinder 5. The concept of the third embodiment is applied to this compressor. A rear plate (not shown) is formed with a first, a second, and a third suction ports 611*a*, 611*b*, and 611*c*, and each of the two vanes 81 has a suction passage 81*c*.

In the embodiment shown in FIG. 24, the rotary vane type compressor includes two vanes 82, each of which penetrates the rotor 111 and is freely movable in the rotor in a longitudinal direction of the vane without any restriction and with both ends of the vane contacting the cylinder 5. The two vanes are arranged perpendicular to each other. The concept of the first embodiment is applied to this compressor. The rear plate (not shown) is formed with a first and a second suction ports 611*a* and 611*b*, and each of the two vanes is formed with suction passages 82*c* near the both ends thereof.

As mentioned above, the invention may be applied to all pipes of rotary vane type compressors regardless of the number of vanes, or the motion form of the vanes.

Although, in the above described embodiments, all of the suction passages formed in the vane, or the vane and the rotor have opening portions opening at the rear side, and the suction ports associated with these suction passages are formed on the rear plate side, it is possible in principle to form these suction passages and suction ports on the front side or on both the rear and front sides.

According to the invention, a variable volume rotary is obtained compressor of rotary vane type, wherein the volume can be adjusted over a wide range, thereby significantly decreasing the frequency in the operation of the magnet clutch in a low heat load operating condition, preventing acceleration and deceleration shock feelings caused by the magnet clutch operations. Further, an internal leakage of the high pressure gas into a lower pressure side may be prevented by providing the volume control means. By virtue of these features, it is possible to minimize the performance deterioration of the compressor in a full capacity operating condition, and to attain a maximum cooling capacity in a high heat load operating condition.

What is claimed is:

1. A rotary compressor of a variable displacement type comprising:

a cylinder having an inner peripheral surface and both axial ends;

a rotor means including a rotor accommodated in said cylinder in an eccentric relationship therewith and at least one vane incorporated in said rotor through an outer periphery of the latter, said vane being movable relative to said rotor reciprocatably in a longitudinal direction of said vane;

two side plates for closing said cylinder at both ends of the latter;

said vane dividing a working space defined by said rotor, said cylinder and said side plates into a plurality of spaces;

suction port means formed in at least one of said side plates and being opened at a surface of the side plate making sliding contact with said rotor;

opening means formed in a rear side portion of the vane as viewed in a direction of said rotor and being opened at a surface of the vane making sliding contact with the rotor, said opening means being adapted to be repeatedly communicated with and interrupted from said working space according to the reciprocative movement of the vane relative to the rotor; and suction passage means formed in said rotor means for establishing a communication between said suction port means and said opening means in a predetermined range of rotation of said rotor means, wherein said suction passage means including a passage formed in said vane and having a depth smaller than a thickness of said vane, said passage having one end opened at a surface of said vane making sliding contact with the side plate and the other end communicated with said opening means.

2. A rotary compressor as claimed in claim 1, wherein said suction passage means includes a first passage formed in said rotor, and a second passage formed in said vane and having one end communicated with said first passage and the other end communicated with said opening means.

3. A rotary compressor of a variable displacement type comprising:

a cylinder having an inner peripheral surface at both axial ends;

a rotor means including a rotor accommodated in said cylinder in an eccentric relationship therewith and at least one vane incorporated in said rotor through an outer periphery of the rotor, said vane being reciprocatably movable relative to said rotor in a longitudinal direction of said vane;

two side plates for closing said cylinder at both ends thereof;

a working space defined by said rotor, said cylinder and said side plates, said vane dividing said working space into a plurality of spaces;

suction port means formed in at least one of said side plates and being opened at a surface of the side plate making sliding contact with said rotor;

opening means formed in a rear side portion of the vane as viewed in a direction of rotation of said rotor and being opened at a surface of the vane making sliding contact with the rotor, said opening means being adapted to be repeatedly communicated with and interrupted from said working space in accordance with the reciprocating movement of the vane relative to the rotor;

suction passage means formed in said rotor means for establishing a communication between said suction port means and said opening means in a predetermined range of rotation of said rotor means;

second suction port means; and means for opening and closing said second suction port means, wherein said suction port means and said suction passage means are so formed so as to interrupt communication between said suction port means and said opening means sufficiently before the working space reaches a maximum volume, and wherein said second suction port means is in communication with the working space until the working space reaches a maximum volume, when the second suction port means is not closed by said opening and closing means.

4. A rotary compressor as claimed in claim 3, wherein said second suction port means includes at least one suction port formed int eh side plate and opened at a surface of the side plate directly exposed to the working space, a breadth of said suction port as viewed in the direction of rotation of said rotor being smaller than a thickness of said vane.

5. A rotary compressor of a variable displacement type comprising:

a cylinder having an inner peripheral surface and two axial ends;

a rotor means including a rotor accommodated in said cylinder in an eccentric relationship therewith and at least one vane incorporated in said rotor through an outer periphery of the rotor, said vane being movable relative to rotor reciprocatably in a longitudinal direction of said vane;

two side plates for closing said cylinder at respective ends thereof;

a working space defined by said rotor, said cylinder and said side plates, said vane dividing said working space into a plurality of spaces;

suction port means formed in at least one of said side plates and being opened at a surface of the side plate making sliding contact with said rotor, wherein said suction port means includes a plurality of suction ports adjacent to each other in the direction of rotation of said rotor, each of said suction ports being opened at a surface of the side plate making sliding contact with said rotor;

opening means formed in a rear side portion of the vane as viewed in a direction of rotation of said rotor and being opened at a surface of the vane making sliding contact with the rotor, said opening means being adapted to be repeatedly communicated with and interrupted from said working space according to the reciprocating movement of the vane relative to the rotor;

suction passage means formed in said rotor means for establishing a communication between said suction port means and said opening means in a predetermined range of rotation of said rotor means; and means for varying a position of a terminal end of said suction port means, as viewed in the direction of rotation of said rotor, said varying means includes means for opening and closing the suction ports except the first suction port as viewed in a direction of rotation of said rotor.

6. A rotary compressor of a variable displacement type comprising:

a cylinder having an inner peripheral surface and both axial ends;

a rotor means including a rotor accommodated in said cylinder in an eccentric relationship therewith and at least one vane incorporated in said rotor through an outer periphery of the latter, said vane being movable relative to said rotor reciprocatably in a longitudinal direction of said vane;

two side plates for closing said cylinder at both ends of the latter;

said vane dividing a working space defined by said rotor, said cylinder and said side plates into a plurality of spaces;

suction port means formed in at least one of said side plates and being opened at a surface of the side plate making sliding contact with said rotor;

opening means formed in a rear side portion of the vane as viewed in a direction of said rotor and being opened at a surface of the vane making sliding contact with the rotor, said opening means being adapted to be repeatedly communicated with and interrupted from said working space according to the reciprocative movement of the vane relative to the rotor;

suction passage means formed in said rotor means for establishing a communication between said suction port means and said opening means in a predetermined range of rotation of said rotor means; and means for varying a position of a terminal end, as viewed in a direction of rotation of said rotor, of said suction port means.

wherein said varying means includes a member defining the terminal end of said suction port means and movable relative to said side plate in the direction of rotation of said rotor, and driving means for moving said member in the latter direction.

* * * * *